US010900103B2

(12) United States Patent
Goto

(10) Patent No.: US 10,900,103 B2
(45) Date of Patent: Jan. 26, 2021

(54) MAGNESIUM-LITHIUM ALLOY, ROLLED MATERIAL AND SHAPED ARTICLE

(71) Applicant: SANTOKU CORPORATION, Kobe (JP)

(72) Inventor: Takayuki Goto, Kobe (JP)

(73) Assignee: SANTOKIJ CORPORATION, Kobe (JP)

( * ) Notice: Subject to any disclaimer, the term of this patent is extended or adjusted under 35 U.S.C. 154(b) by 0 days.

(21) Appl. No.: 15/544,784

(22) PCT Filed: Jan. 26, 2016

(86) PCT No.: PCT/JP2016/052088
§ 371 (c)(1),
(2) Date: Jul. 19, 2017

(87) PCT Pub. No.: WO2016/121722
PCT Pub. Date: Aug. 4, 2016

(65) Prior Publication Data

US 2017/0369972 A1 Dec. 28, 2017

(30) Foreign Application Priority Data

Jan. 27, 2015 (JP) ..... 2015-13644

(51) Int. Cl.

| | |
|---|---|
| ***C22C 23/02*** | (2006.01) |
| ***C22C 23/00*** | (2006.01) |
| ***B21B 3/00*** | (2006.01) |
| ***C22F 1/06*** | (2006.01) |
| *C22F 1/00* | (2006.01) |

(52) U.S. Cl.
CPC ..... *C22C 23/02* (2013.01); *B21B 3/00* (2013.01); *C22C 23/00* (2013.01); *C22F 1/06* (2013.01); *C22F 1/00* (2013.01)

(58) Field of Classification Search
CPC ..... C22F 1/06; C22C 23/02; C22C 23/00
See application file for complete search history.

(56) References Cited

U.S. PATENT DOCUMENTS

| | | | |
|---|---|---|---|
| 5,059,390 | A | 10/1991 | Burleigh et al. |
| 2002/0197529 | A1 | 12/2002 | Moriwaki et al. |

FOREIGN PATENT DOCUMENTS

| | | | |
|---|---|---|---|
| CN | 1924055 | A | 3/2007 |
| CN | 103031474 | A | 4/2013 |
| CN | 103643096 | A | 3/2014 |
| JP | 04-176839 | A | 6/1992 |
| JP | 06279905 | A | 10/1994 |
| JP | 09-041066 | A | 2/1997 |
| JP | 2000-282165 | A | 10/2000 |
| JP | 2001-283796 | A | 10/2001 |

OTHER PUBLICATIONS

Li, Shuang-Shou, Bin Tang, and Da-Ben Zeng. "Effects and mechanism of Ca on refinement of AZ91D alloy." Journal of alloys and compounds 437.1-2 (2007): 317-321.*

Jensen, J. A., and L. Scott Chumbley. "Processing and mechanical properties of magnesium-lithium composites containing steel fibers." Metallurgical and Materials Transactions A 29.3 (1998): 863-873.*

State Intellectual Property Office of the P.R.C.; Communication dated Apr. 3, 2018 in counterpart Application No. 201680009998.9.

International Bureau; International Preliminary Report on Patentability with translation of Written Opinion issued in counterpart International Application No. PCT/JP2016/052088, dated Aug. 10, 2017.

Kazuo Matsuzawa, et al., "The effect of additional element on the age-hardening characteristics and properties of Mg—Li alloys", Light Metals, Feb. 6, 1990, vol. 40, No. 9, pp. 659-665.

International Search Report for PCT/JP2016/052088 dated Mar. 8, 2016 [PCT/ISA/210].

Written Opinion for PCT/JP2016/052088 dated Mar. 8, 2016 [PCT/ISA/237].

European Patent Office; Communication dated May 17, 2018 in counterpart European Application No. 16743325.9.

Nikulin, et al., "Selection of an alloying complex for a magnesium-lithium alloy", Chemical Abstracts, Jan. 14, 1985, XP002158670, (2 pages).

Yanzhuo LV, et al., "The effect of NaF on the electrochemical behavior of the Mg—11Li—3.5Al—1Zn—1Sn—1Ce—0.1Mn electrode in NaCl solution", RSC Advances, vol. 5, No. 58, May 12, 2015, pp. 46423-46429, XP055472962, (7 page).

Lin, M.C., et al., "Electrochemical behaviour and corrosion performance of Mg—Li—Al—Zn anodes with high Al composition", Corrosion Science, Oxford, vol. 51, No. 10, Jun. 18, 2009, pp. 2463-2472, XP026565300, (10 pages).

R. M. Brodskaya et al., "Electron Microscopic Study of the Structure of Magnesium-Lithium B-Alloys", UDC 669.721.5.669.884:620.18 (Translated from Metallovedenie I Termicheskaya Obrabotka Metallov, No. 5, pp. 78-29, May 1975) total 7 pgs (including translation).

* cited by examiner

*Primary Examiner* — Jessee R Roe
(74) *Attorney, Agent, or Firm* — Sughrue Mion, PLLC

(57) ABSTRACT

An Mg—Li alloy contains more than 10.50% by mass and not more than 16.00% by mass of Li, not less than 2.00% by mass and not more than 15.00% by mass of Al, not less than 0.03% by mass and less than 1.10% by mass of Mn, impurities, and the balance of Mg. The impurities contain Fe at a concentration of 15 ppm or less. The alloy may optionally contain M, which is at least one element selected from the group consisting Ca, Zn, Si, Y, and rare earth metal elements with atomic numbers of 57 to 71.

12 Claims, 2 Drawing Sheets

MAGNESIUM-LITHIUM ALLOY, ROLLED MATERIAL AND SHAPED ARTICLE

CROSS REFERENCE TO RELATED APPLICATIONS

This application is a National Stage of International Application No. PCT/JP2016/052088 filed Jan. 26, 2016, claiming priority based on Japanese Patent Application No. 2015-013644 filed Jan. 27, 2015, the contents of all of which are incorporated herein by reference in their entirety.

FIELD OF ART

The present invention relates to a magnesium-lithium alloy having a particularly improved corrosion resistance, and a rolled material and a formed article prepared therefrom.

BACKGROUND ART

In recent years, lightweight magnesium alloys have been attracting much attention as structural metal materials. However, a rolled material of a common magnesium alloy AZ31 (containing 3% by mass of Al, 1% by mass of Zn, and the balance of Mg) is poor in cold workability, and cannot be press-worked at a temperature of lower than about 250° C. While magnesium forms an hcp crystal structure (a phase), magnesium-lithium alloys containing lithium have a mixed phase of an hcp structure and a bcc structure (β phase) at a lithium content of 6% to 10.5% by mass and have a single β phase at a lithium content of more than 10.5% by mass. The β phase has a large number of slip systems, whereas the α phase has a limited number thereof. Therefore, as the lithium content is increased, the mixed α/β phase is converted to the single β phase, whereby the cold workability is improved. As such magnesium-lithium alloys, LZ91 (containing 9% by mass of Li, 1% by mass of Zn, and the balance of Mg), LA141 (containing 14% by mass of Li, 1% by mass of Al, and the balance of Mg), and the like have been widely known. The magnesium-lithium alloys are advantageously lightweight, but have a problem of inferior corrosion resistance to be improved.

Patent Publication 1 discloses that a magnesium-lithium alloy having a lithium content of 10.5% by mass or less and an impurity iron concentration of 50 ppm or less has an excellent corrosion resistance. Furthermore, Patent Publication 1 describes that when the lithium content is more than 10.5% by mass, the resultant magnesium-lithium alloy has the single β phase structure and exhibits a significantly deteriorated corrosion resistance. Specifically, in Examples of Patent Publication 1, each magnesium-lithium alloy has a lithium content of 10.5% by mass or less and a reduced impurity iron concentration, and thereby has excellent corrosion resistances. In contrast, in Comparative Example 6 of Patent Publication 1, a magnesium-lithium alloy has a single β phase structure with a lithium content of 14% by mass, so that the advantageous effect due to the reduction of the impurity iron concentration is not achieved.

Non-Patent Publication 1 discloses results of studies on mechanical properties, corrosion resistance, and the like of magnesium-lithium alloys containing 13% by mass of lithium and 1%, 3%, or 5% by mass of aluminum in processing, heat treatment etc.

Specifically, Non-Patent Publication 1 describes that as the aluminum content is increased, the tensile strength is increased, while the specific strength is slightly lowered.

Non-Patent Publication 1 further describes that as the aluminum content is increased, the corrosion resistance is improved, but is lower than those of binary lithium-magnesium alloys.

PRIOR ART PUBLICATIONS

Patent Publication 1: JP 2000-282165 A

Non-Patent Publication 1: Keikinzoku (Journal of Japan Institute of Light Metals), Vol. 40 (1990), No. 9, Pages 659-665

SUMMARY OF THE INVENTION

Problem to be Solved by the Invention

There has been a demand for developing a new technology for achieving a practicable corrosion resistance in a magnesium-lithium alloy having a lithium content suitable for forming a single β phase with an excellent cold workability and an aluminum content suitable for achieving an excellent tensile strength.

An object of the present invention is to provide a lightweight magnesium-lithium alloy that can exhibit a practicable corrosion resistance with excellent cold workability and tensile strength.

Another object of the present invention is to provide lightweight rolled material and formed article that can exhibit a practicable corrosion resistance with an excellent tensile strength.

Means for Solving the Problem

As described above, Patent Publication 1 specifies that the effect due to the reduction of the impurity iron concentration is not obtained in a lithium-magnesium alloy having a lithium content of more than 10.5% by mass and thus a single β phase with an excellent cold workability. As a result of intense research in view of the above objects, the inventor has found that by controlling the aluminum content of such a lithium-magnesium alloy to achieve an excellent tensile strength and by adding a predetermined amount of manganese to the lithium-magnesium alloy, the corrosion resistance can be improved, and the effect due to the reduction of the impurity iron concentration can be obtained. The present invention has been accomplished based on this finding.

According to an aspect of the present invention, there is provided a magnesium-lithium alloy comprising more than 10.50% by mass and not more than 16.00% by mass of Li, not less than 2.00% by mass and not more than 15.00% by mass of Al, not less than 0.03% by mass and less than 1.10% by mass of Mn, impurities, and the balance of Mg, wherein the impurities contain Fe at a concentration of 15 ppm or less. This magnesium-lithium alloy may be hereinafter referred to as the Mg—Li alloy of the present invention.

According to another aspect of the present invention, there is provided a magnesium-lithium alloy comprising more than 10.50% by mass and not more than 16.00% by mass of Li, not less than 2.00% by mass and not more than 15.00% by mass of Al, not less than 0.03% by mass and less than 1.10% by mass of Mn, M, impurities, and the balance of Mg, wherein M represents at least one element selected from the group consisting of more than 0% by mass and not more than 3.00% by mass of Ca, more than 0% by mass and not more than 3.00% by mass of Zn, more than 0% by mass and not more than 1.00% by mass of Si, more than 0% by mass and not more than 1.00% by mass of Y, and more than 0% by mass and not more than 5.00% by mass of rare earth metal elements with atomic numbers of 57 to 71, and the impurities contain Fe at a concentration of 15 ppm or less. This magnesium-lithium alloy may be hereinafter referred to as the Mg—Li alloy of the present invention.

According to a further aspect of the present invention, there is provided a rolled material or a formed article comprising the Mg—Li alloy of the present invention.

Effect of the Invention

The Mg—Li alloy of the present invention can have a single β phase structure with an excellent cold workability due to the above particular Li content, and can have an excellent tensile strength due to the above particular Al content. In addition, since the Al content and the Mn content are controlled within particular ranges, and the impurity Fe concentration is lowered, the Mg—Li alloy can have an excellent practicable corrosion resistance.

The rolled material and the formed article of the present invention contain the Mg—Li alloy of the present invention, and thereby can have an excellent tensile strength, a practicable corrosion resistance, and a light weight. Therefore, the rolled material and the formed article can be used in various fields of automobile parts and casing parts of portable audio devices, digital cameras, mobile phones, notebook computers, etc.

EMBODIMENTS OF THE INVENTION

Figure 1:
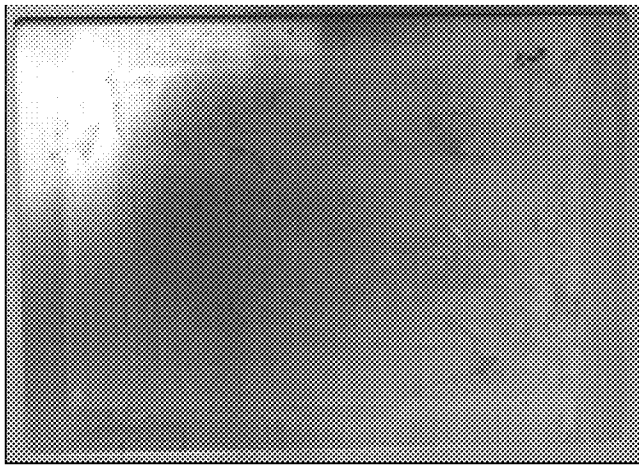
FIG. 1 is a photograph of a surface of a rolled material produced in Example 1, taken after a neutral salt spray test.

The present invention will be described in detail below.

The Mg—Li alloy of the present invention contains particular amounts of Li, Al, and Mn, impurities, and the balance of Mg, or contains particular amounts of Li, Al, Mn, and M, impurities, and the balance of Mg.

In the Mg—Li alloy of the present invention, the Li content is more than 10.50% by mass and not more than 16.00% by mass. When the Li content is 10.50% by mass or less, the Mg—Li alloy has a single α phase structure or a eutectic α/β structure, and therefore has a lowered cold workability. When the Li content is more than 16.00% by mass, the Mg—Li alloy has lowered corrosion resistance and strength, and cannot be put into practical use. Conventional Mg—Li alloys having Li contents within the above range have a single β phase crystal structure. The Mg—Li alloy of the present invention has a high Al content and thus a structure containing an aluminum intermetallic phase in addition to the main β phase, and therefore has a light weight and an excellent workability.

In the Mg—Li alloy of the present invention, the Al content is not less than 2.00% by mass and not more than 15.00% by mass. When the Al content is less than 2.00% by mass, the corrosion resistance of the Mg—Li alloy is less effectively improved. When the Al content is more than 15.00% by mass, the Mg—Li alloy has a large specific gravity (density) and loses the lightweight advantage.

In the Mg—Li alloy of the present invention, the Mn content is not less than 0.03% by mass and less than 1.10% by mass, preferably not less than 0.03% by mass and not more than 0.50% by mass, more preferably not less than 0.10% by mass and not more than 0.30% by mass. Mn can generate an intermetallic compound together with Fe, and can act to improve the corrosion resistance of the alloy. In addition, although the corrosion resistance improvement effect due to the reduction of the impurity Fe concentration is not obtained in Patent Publication 1, this effect is achieved by adding the particular amount of Mn in the present invention. Thus, in the present invention, the corrosion resistance can be further improved by the combination of the reduction of the impurity Fe concentration and the addition of the particular amount of Mn. When the Mn content is less than 0.03% by mass, the desired corrosion resistance improvement effect cannot be obtained. When the Mn content is increased, the Mg—Li alloy may lose the lightweight advantage.

In the Mg—Li alloy of the present invention, examples of the impurities include Fe, Ni, and Cu. Thus, the Mg—Li alloy may contain a small amount of the impurities as long as the strength, the corrosion resistance, and the like of the Mg—Li alloy is not deteriorated by the impurities.

The Mg—Li alloy of the present invention has an impurity Fe concentration of 15 ppm or less, preferably 10 ppm or less. When the Fe concentration is more than 15 ppm, the corrosion resistance is lowered.

The Mg—Li alloy of the present invention has an impurity Ni concentration of preferably 15 ppm or less, more preferably 10 ppm or less. When the Mg—Li alloy contains an excessively large amount of Ni, the corrosion resistance is lowered disadvantageously. Even in the Mg—Li alloy having a Li content of more than 10.50% by mass, the corrosion resistance improvement effect due to the reduction of the impurity Ni concentration can be obtained as well as the effect due to the impurity Fe concentration reduction.

The Mg—Li alloy of the present invention preferably has an impurity Cu concentration of 10 ppm or less. When the Cu concentration is lowered to this range, the corrosion resistance of the Mg—Li alloy can be further improved.

In the Mg—Li alloy of the present invention, M represents one or more elements selected from the group consisting of Ca, Zn, Si, Y, and rare earth metal elements with atomic numbers of 57 to 71 (hereinafter referred to simply as the rare earth metal elements). Preferred examples of the rare earth metal elements include La, Ce, Pr, and Nd.

With regard to the element(s) M, each of the Ca content and the Zn content is more than 0% by mass and not more than 3.00% by mass, the Si content is more than 0% by mass and not more than 1.00% by mass, the Y content is more than 0% by mass and not more than 1.00% by mass, and the content of the rare earth metal element(s) is more than 0% by mass and not more than 5.00% by mass.

By adding a predetermined amount of Ca as M to the Mg—Li alloy, the corrosion resistance of the alloy is further improved. Ca can generate a compound together with Mg, and the compound acts as an origin of nucleation in a recrystallization process, to form a recrystallization texture containing fine crystal grains. Corrosion of the Mg—Li alloy proceeds selectively at the crystal grain boundaries, and the progress of corrosion can be inhibited by forming such fine crystal grains. Thus, the corrosion resistance can be improved by forming such fine crystal grain boundaries. When the Ca content is more than 3.00% by mass, the strength and the workability of the Mg—Li alloy may be lowered.

By adding Zn or Y as M to the Mg—Li alloy, the workability of the Mg—Li alloy can be further improved. By adding Si to the Mg—Li alloy, the high-temperature strength of the alloy can be further improved. By adding the rare earth element to the Mg—Li alloy, the elongation of the alloy can be improved, and thus the cold workability can be further improved. However, when the Zn content is more than 3.00% by mass or the Si content amount is more than 1.00% by mass, the strength and the workability of the Mg—Li alloy may be lowered. When the Y content is more than 1.00% by mass, the high-temperature strength of the Mg—Li alloy may be lowered. When the rare earth element content is more than 5% by mass, the specific gravity of the Mg—Li alloy may be excessively increased.

The Mg—Li alloy of the present invention may optionally contain one or more elements selected from the group consisting of Zr, Ti, and B in addition to the above-described elements, as long as the objective corrosion resistance improvement effect is not greatly affected by the elements. For example, the strength of the Mg—Li alloy is further increased by Zr, and the flame resistance of the Mg—Li alloy is increased by Ti. The content of these optional elements is preferably not less than 0% by mass and not more than 5.00% by mass. When the content of the optional elements is excessively high, the specific gravity is increased, so that the Li—Mg alloy of the present invention loses the lightweight advantage. Therefore, it is preferred that the content of the optional elements is minimized.

The Mg—Li alloy of the present invention preferably has a corrosion amount of 0.160 mg/cm$^2$/day or less. The corrosion amount is one of measures for evaluating the corrosion resistance. When the Mg—Li alloy has a smaller corrosion amount, the Mg—Li alloy is more excellent in the corrosion resistance.

The corrosion amount can be measured by a neutral salt spray test in accordance with JIS Z 2371. Specifically, a test sample is weighed before and after the test to obtain a weight loss per unit area during a test period (72 hours=3 days, as described in Examples below), and the corrosion amount (mg/cm$^2$/day) is calculated from the weight loss and the elapsed days.

When crystal grains in the Mg—Li alloy of the present invention are finer, the alloy has a higher effect for inhibiting the corrosion progress and thus exhibits a higher corrosion resistance. The average crystal grain diameter of the Mg—Li alloy is preferably 40 μm or less, particularly preferably 20 μm or less.

The average crystal grain diameter can be measured by a line intercept method using an optical microscope image of a cross-sectional structure of the Mg—Li alloy as follows. A sample etched with a 5% nitric acid ethanol solution is observed by an optical microscope at 200-fold magnification to obtain the image. Five lines having a length corresponding to 600 μm are drawn in the image to equally divide the image into six, and the number of grain boundaries crossing each line is counted. The length of 600 μm is divided by the counted number of the grain boundaries on each line, and the average of thus obtained values is used as the average crystal grain diameter.

The Mg—Li alloy of the present invention preferably has a tensile strength of 160 MPa or more. The upper limit of the tensile strength is not particularly limited, and the tensile strength may be controlled in view of not lowering the cold workability. The tensile strength within the above range is equal to or higher than those of industrially-available LA141 and LZ91.

The tensile strength can be determined by preparing a plate of the Mg—Li alloy of the present invention, cutting out three 1-mm-thick test samples of JIS No. 5 from the plate along each of lines at 0°, 45°, and 90° with respect to an arbitrarily-selected direction, and measuring the tensile strength values of the test samples at 25° C. at a tensile rate of 10 mm/minute. The average value of the measured values is calculated at each angle of 0°, 45°, and 90°, and the maximum value among the three average values is obtained as the tensile strength of the Mg—Li alloy.

A method for producing the Mg—Li alloy of the present invention is not particularly limited, as long as it is capable of producing the Mg—Li alloy with the above-described composition and properties. For example, the Mg—Li alloy may be preferably produced by the following method.

The method contains (a) preparing a raw material and (b) melting the raw material, and cooling and solidifying the melt to obtain an alloy ingot (slab). The raw material contains more than 10.50% by mass and not more than 16.00% by mass of Li, not less than 2.00% by mass and not more than 15.00% by mass of Al, not less than 0.03% by mass and less than 1.10% by mass of Mn, impurities, and the balance of Mg, and the impurities contain Fe at a concentration of 15 ppm or less. Or alternatively, the raw material contains more than 10.50% by mass and not more than 16.00% by mass of Li, not less than 2.00% by mass and not more than 15.00% by mass of Al, not less than 0.03% by mass and less than 1.10% by mass of Mn, M, impurities, and the balance of Mg, M is at least one element selected from the group consisting of more than 0% by mass and not more than 3.00% by mass of Ca, more than 0% by mass and not more than 3.00% by mass of Zn, more than 0% by mass and not more than 1.00% by mass of Si, more than 0% by mass and not more than 1.00% by mass of Y, and more than 0% by mass and not more than 5.00% by mass of the rare earth metal elements, and the impurities contain Fe at a concentration of 15 ppm or less.

The method may further contain (b1) subjecting the alloy ingot obtained in the step (b) to a thermal homogenization treatment. The thermal homogenization treatment is carried out generally at a temperature of 200° C. to 300° C. for 1 to 24 hours.

The method may further contain (b2) subjecting the alloy ingot obtained in the step (b) or (b1) to a hot rolling treatment. The hot rolling treatment is carried out generally at a temperature of 200° C. to 400° C.

In the step (a), for example, metals or mother alloys containing the above elements may be mixed at the above composition ratio to prepare the raw material.

In the step (b), for example, it is preferred that the raw material melt is cast into a mold and cooled and solidified to obtain the alloy ingot. Alternatively, it is also preferred that the raw material melt is cooled and solidified by a continuous casting method such as a strip casting method.

In general, the alloy ingot obtained in the step (b) may have a thickness of about 10 to 300 mm.

The rolled material of the present invention contains the Mg—Li alloy of the present invention, and has an excellent corrosion resistance. In general, the rolled material may have a thickness of about 0.01 to 5 mm.

The rolled material of the present invention may be produced by subjecting the Mg—Li alloy of the present invention (e.g. the alloy ingot obtained in the step (b), (b1), or (b2)) to a cold plastic working treatment and a heat treatment. The cold plastic working treatment is preferably performed at a rolling reduction of 30% or more.

In the cold plastic working treatment, a known method such as rolling, forging, extruding, or drawing may be carried out to generate a strain in the Mg—Li alloy. The treatment is carried out generally at a temperature of room temperature to about 300° C. It is preferred from the viewpoint of generating a larger strain that the treatment is carried out at room temperature or at as low a temperature as possible.

The rolling reduction in the plastic working is preferably 40% or more, more preferably 45% or more, most preferably 90% or more. The upper limit of the rolling reduction is not particularly limited.

In the next heat treatment, the Mg—Li alloy, which has a certain degree of the strain generated by the plastic working, is annealed and recrystallized. The heat treatment is preferably carried out at a temperature of 150° C. or higher but lower than 350° C. for 10 minutes to 12 hours or at a temperature of 250° C. to 400° C. for 10 seconds to 30 minutes. The heat treatment is particularly preferably carried out at a temperature of 180° C. to 300° C. for 30 minutes to 4 hours or at a temperature of 250° C. to 350° C. for 30 seconds to 20 minutes. In a case where the heat treatment is carried out under conditions other than the above conditions, the resultant rolled material may have a lowered strength, although the corrosion resistance is not particularly affected by the conditions.

Since the Mg—Li alloy of the present invention has the excellent cold workability, the rolled material of the present invention can be produced from the Mg—Li alloy with a high dimensional accuracy without cracking and appearance defect. Thus, production efficiency of a formed article or the like can be improved by using the rolled material. The rolled material is suitable for use in a formed article such as an automobile part or a casing part of a portable audio device, a digital camera, a mobile phone, a notebook computer, etc.

The formed article of the present invention contains the Mg—Li alloy of the present invention, and has an excellent corrosion resistance.

In production of the formed article of the present invention, the Mg—Li alloy of the present invention may be formed into a desired shape by rolling or the like, and may be subjected to a surface treatment if necessary. The surface treatment may be selected from known treatments for magnesium-based alloys and magnesium-lithium alloys. For example, first, a degreasing treatment using an organic solvent such as a hydrocarbon or an alcohol, a blasting treatment for removing an oxide film or for roughening the surface, an etching treatment using an acid or an alkali or the like may be carried out if necessary. Then, a chemical conversion treatment or an anodization treatment may be carried out.

In the chemical conversion treatment, for example, a known treatment such as a chromate treatment or a non-chromate treatment may be carried out in accordance with JIS.

In the anodization treatment, an electrolysis condition such as electrolytic solution, film formation stabilizing agent, current density, voltage, temperature, or time may be appropriately selected.

A coating treatment may be carried out if necessary after the chemical conversion treatment or the anodization treatment. In the coating treatment, a known method such as electrodeposition coating, spray coating, or dip coating may be conducted. A known organic or inorganic coating material may be used in the coating treatment. An FPF (Finger Print Free) treatment for a titanium alloy or the like (glassy coating treatment) may be carried out instead of the above coating treatment after the anodization treatment, to form an excellent film having a high adhesion and a high density on the magnesium-lithium alloy.

A heat treatment may be carried out before or after the surface treatment if necessary.

EXAMPLES

The present invention will be described in more detail below with reference to Examples without intension of restricting the invention.

Example 1

A raw material containing 14.09% by mass of Li, 8.67% by mass of Al, 0.23% by mass of Mn, 0.86% by mass of Ca, and the balance of Mg was heated and melted to obtain an alloy melt. The alloy melt was cast into a mold of 150 mm×300 mm×500 mm to prepare an alloy ingot. The composition of the alloy ingot was determined by a quantitative ICP (Inductively Coupled Plasma) emission spectroscopic analysis. The results are shown in Table 1.

Figure 3:
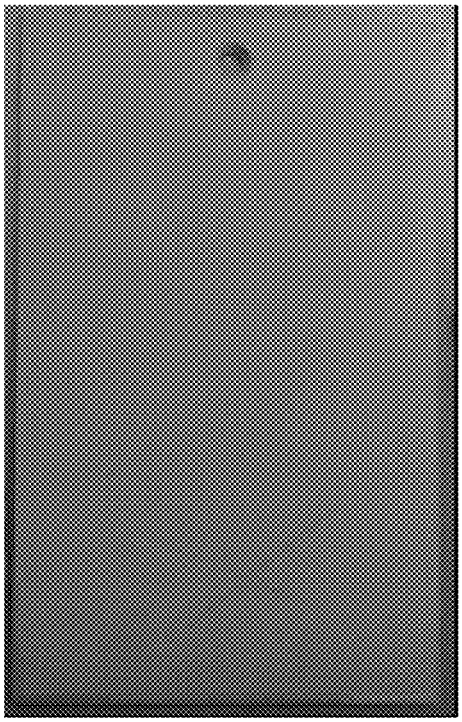
FIG. 3 is a photograph of a surface of a test sample obtained by subjecting the rolled material of Example 1 to a surface anodization treatment, taken after the neutral salt spray test.

The alloy ingot was heat-treated at 300° C. for 24 hours, and a surface of the alloy ingot was cut to prepare a slab having a thickness of 130 mm for rolling. The slab was rolled at 350° C. into a 4-mm-thick plate shape, and further rolled at the room temperature at a rolling reduction of 75% into a 1-mm-thick plate shape, to obtain a rolled body. The rolled body was annealed (heat-treated) at 230° C. for 1 hour to produce a rolled material. The produced rolled material was subjected to the following neutral salt spray test. The result is shown in Table 1. A photograph of a surface of the rolled material was taken after the neutral salt spray test. A copy of the photograph is shown in FIG. 1. Furthermore, the produced rolled material was subjected to a surface anodization treatment to prepare a test sample. A photograph of a surface of the test sample was taken after the neutral salt spray test. A copy of the photograph is shown in FIG. 3.

Neutral Salt Spray Test

In the neutral salt spray test, in accordance with JIS Z 2371, the rolled material was introduced into a test container having a controlled temperature of 35° C.±2° C., sprayed with a 5% saline solution (50±5 g/l), left to stand at a pH of 6.5 to 7.2 for 72 hours, and taken out from the test container. A corrosion product attached to the surface of the rolled material was removed by a chromic acid solution, and the surface was water-washed. Then, the corrosion amount ($mg/cm^2/day$) of the rolled material was calculated from the elapsed days (72 hours=3 days in this test) and the weight loss per unit area during the test period of 72 hours.

Tensile Strength Test

The tensile strength of the produced rolled material was measured as described above. The rolled material was evaluated as acceptable when it had a tensile strength of 160 MPa or more, and was evaluated as unacceptable when it had a tensile strength of less than 160 MPa.

Examples 2 to 8 and Comparative Examples 1 to 6

Figure 2:
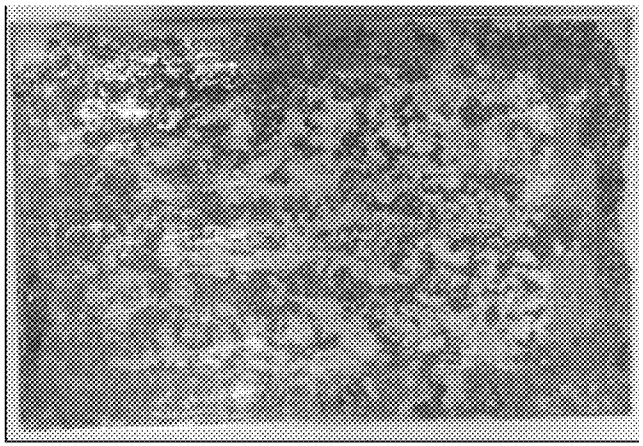
FIG. 2 is a photograph of a surface of a rolled material produced in Comparative Example 1, taken after the neutral salt spray test.
Figure 4:
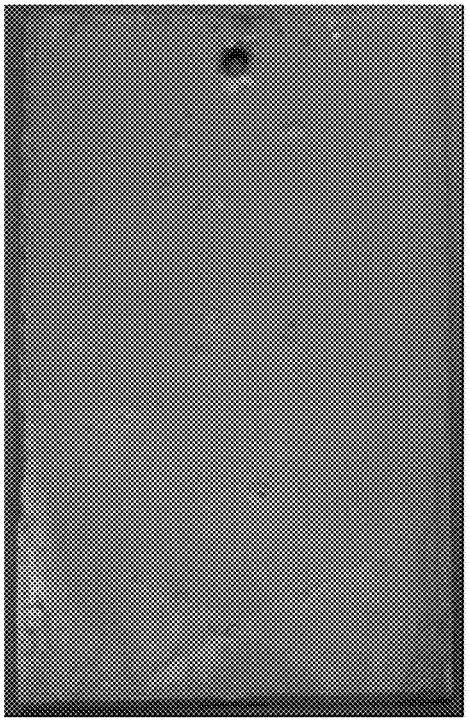
FIG. 4 is a photograph of a surface of a test sample obtained by subjecting the rolled material of Comparative Example 1 to the surface anodization treatment, taken after the neutral salt spray test.

Alloy ingots and rolled materials were produced and evaluated in the same manner as Example 1 except for using the following raw materials respectively. The results are shown in Table 1. In Comparative Example 1, a photograph of a surface of the rolled material was taken after the neutral salt spray test in the same manner as Example 1. A copy of the photograph is shown in FIG. 2. Furthermore, the rolled material of Comparative Example 1 was subjected to a surface anodization treatment to prepare a test sample. A photograph of a surface of the test sample was taken after the neutral salt spray test. A copy of the photograph is shown in FIG. 4.

Raw Material of Example 2

15.51% by mass of Li, 14.54% by mass of Al, 0.21% by mass of Mn, 0.94% by mass of Ca, and the balance of Mg Raw Material of Example 3

10.90% by mass of Li, 6.55% by mass of Al, 0.24% by mass of Mn, and the balance of Mg Raw Material of Example 4

13.97% by mass of Li, 12.03% by mass of Al, 0.24% by mass of Mn, 1.53% by mass of Ca, 0.071% by mass of Y, and the balance of Mg Raw Material of Comparative Example 1

14.05% by mass of Li, 8.78% by mass of Al, 0.28% by mass of Mn, 0.94% by mass of Ca, and the balance of Mg Raw Material of Comparative Example 2

13.09% by mass of Li, 9.27% by mass of Al, 0.02% by mass of Mn, and the balance of Mg Raw Material of Comparative Example 3

13.71% by mass of Li, 6.31% by mass of Al, 1.10% by mass of Mn, and the balance of Mg Raw Material of Comparative Example 4

14.39% by mass of Li, 11.27% by mass of Al, 0.026% by mass of Mn, 2.03% by mass of Ca, and the balance of Mg Raw Material of Comparative Example 5

13.69% by mass of Li, 1.07% by mass of Al, 0.037% by mass of Mn, 0.27% by mass of Ca, and the balance of Mg Raw Material of Comparative Example 6

14.05% by mass of Li, 1.05% by mass of Al, 0.20% by mass of Mn, 0.26% by mass of Ca, and the balance of Mg

TABLE 1

| | Magnesium-lithium alloy composition (% or ppm by mass) | | | | | | | | | | | | | Corrosion rate |
|---|---|---|---|---|---|---|---|---|---|---|---|---|---|---|
| No. | Li | Al | Mn | Fe | Ni | Mg | Ca | Y | Ce | Nd | Gd | Si | Zn | mg/cm$^2$/day |
| Ex. 1 | 14.09 | 8.67 | 0.23 | 5 ppm | 9 ppm | Bal. | 0.86 | — | — | — | — | — | — | 0.04 |
| Ex. 2 | 15.51 | 14.54 | 0.21 | 10 ppm | 6 ppm | Bal. | 0.94 | — | — | — | — | — | — | 0.065 |
| Ex. 3 | 10.90 | 6.55 | 0.24 | 7 ppm | 6 ppm | Bal. | — | — | — | — | — | — | — | 0.089 |
| Ex. 4 | 13.97 | 12.03 | 0.24 | 3 ppm | 2 ppm | Bal. | 1.53 | 0.071 | — | — | — | — | — | 0.067 |
| Ex. 5 | 14.01 | 7.01 | 0.28 | 8 ppm | 6 ppm | Bal. | — | — | — | — | — | 0.104 | — | 0.079 |
| Ex. 6 | 10.60 | 6.81 | 0.26 | 9 ppm | 5 ppm | Bal. | 0.24 | — | — | — | — | — | 1.51 | 0.095 |
| Ex. 7 | 13.53 | 2.57 | 0.26 | 6 ppm | 10 ppm | Bal. | 0.31 | — | — | — | — | — | — | 0.151 |
| Ex. 8 | 13.55 | 8.87 | 1.01 | 3 ppm | 5 ppm | Bal. | — | — | — | — | — | — | — | 0.067 |
| Ex. 9 | 14.21 | 9.51 | 0.32 | 2 ppm | 1 ppm | Bal. | 1.97 | — | 0.14 | — | — | — | — | 0.056 |
| Ex. 10 | 13.45 | 6.23 | 0.18 | 4 ppm | 2 ppm | Bal. | 1.03 | — | — | 0.06 | — | — | — | 0.076 |
| Ex. 11 | 12.27 | 4.14 | 0.26 | 8 ppm | 6 ppm | Bal. | 0.12 | — | — | — | 0.08 | — | — | 0.091 |
| Comp. Ex. 1 | 14.05 | 8.78 | 0.28 | 31 ppm | 16 ppm | Bal. | 0.94 | — | — | — | — | — | — | 0.275 |
| Comp. Ex. 2 | 13.09 | 9.27 | 0.02 | 25 ppm | 17 ppm | Bal. | — | — | — | — | — | — | — | 0.451 |
| Comp. Ex. 3 | 13.71 | 6.31 | 1.10 | 29 ppm | 11 ppm | Bal. | — | — | — | — | — | — | — | 0.221 |
| Comp. Ex. 4 | 14.39 | 11.27 | 0.026 | 10 ppm | 7 ppm | Bal. | 2.03 | — | — | — | — | — | — | 0.231 |
| Comp. Ex. 5 | 13.69 | 1.07 | 0.037 | 10 ppm | 10 ppm | Bal. | 0.27 | — | — | — | — | — | — | 0.81 |
| Comp. Ex. 6 | 14.05 | 1.05 | 0.20 | 10 ppm | 10 ppm | Bal. | 0.26 | — | — | — | — | — | — | 0.19 |

Raw Material of Example 5

14.01% by mass of Li, 7.01% by mass of Al, 0.28% by mass of Mn, 0.104% by mass of Si, and the balance of Mg Raw Material of Example 6

10.60% by mass of Li, 6.81% by mass of Al, 0.26% by mass of Mn, 0.24% by mass of Ca, 1.51% by mass of Zn, and the balance of Mg Raw Material of Example 7

13.53% by mass of Li, 2.57% by mass of Al, 0.26% by mass of Mn, 0.31% by mass of Ca, and the balance of Mg Raw Material of Example 8

13.55% by mass of Li, 8.87% by mass of Al, 1.01% by mass of Mn, and the balance of Mg Raw Material of Example 9

14.21% by mass of Li, 9.51% by mass of Al, 0.32% by mass of Mn, 1.97% by mass of Ca, 0.14% by mass of Ce, and the balance of Mg Raw Material of Example 10

13.45% by mass of Li, 6.23% by mass of Al, 0.18% by mass of Mn, 1.03% by mass of Ca, 0.06% by mass of Nd, and the balance of Mg Raw Material of Example 11

12.27% by mass of Li, 4.14% by mass of Al, 0.26% by mass of Mn, 0.12% by mass of Ca, 0.08% by mass of Gd, and the balance of Mg As is clear from Table 1, the Mg—Li alloys of Examples exhibited significantly lower corrosion rates and thus more excellent corrosion resistances as compared with the Mg—Li alloys of Comparative Examples.

What is claimed is:

1. A magnesium-lithium alloy consisting of not less than % 13.55% by mass and not more than 16.00% by mass of Li, not less than 2.00% by mass and not more than 15.00% by mass of Al, not less than 0.03% by mass and less than 1.10% by mass of Mn, impurities, and the balance of Mg, wherein the impurities contain Fe at a concentration of 15 ppm or less.

2. The magnesium-lithium alloy according to claim 1, wherein the impurities contain Ni at a concentration of 15 ppm or less.

3. The magnesium-lithium alloy according to claim 2, wherein the magnesium-lithium alloy has a corrosion amount of 0.160 mg/cm$^2$/day or less measured in a 72-hour neutral salt spray test in accordance with JIS Z 2371.

4. The magnesium-lithium alloy according to claim 1, wherein the magnesium-lithium alloy has a corrosion amount of 0.160 mg/cm$^2$/day or less measured in a 72-hour neutral salt spray test in accordance with JIS Z 2371.

5. A rolled material comprising the magnesium-lithium alloy according to claim 1.

6. A formed article comprising the magnesium-lithium alloy according to claim 1.

7. The magnesium-lithium alloy according to claim 1, comprising not less than 2.57% by mass and not more than 15.00% by mass of Al.

8. A magnesium-lithium alloy consisting of not less than 13.55% by mass and not more than 16.00% by mass of Li, not less than 2.00% by mass and not more than 15.00% by mass of Al, not less than 0.03% by mass and less than 1.10% by mass of Mn, M, impurities, and the balance of Mg, wherein M contains more than 0% by mass and not more than 3.00% by mass of Ca and optionally further contains at least one element selected from the group consisting of more than 0% by mass and not more than 3.00% by mass of Zn, more than 0% by mass and not more than 1.00% by mass of Si, more than 0% by mass and not more than 1.00% by mass of Y, and more than 0% by mass and not more than 5.00% by mass of rare earth metal elements with atomic numbers of 57 to 71, and wherein the impurities contain Fe at a concentration of 15 ppm or less.

9. The magnesium-lithium alloy according to claim 8, wherein the impurities contain Ni at a concentration of 15 ppm or less.

10. The magnesium-lithium alloy according to claim 9, wherein the magnesium-lithium alloy has a corrosion amount of 0.160 $mg/cm^2/day$ or less measured in a 72-hour neutral salt spray test in accordance with JIS Z 2371.

11. The magnesium-lithium alloy according to claim 8, wherein the magnesium-lithium alloy has a corrosion amount of 0.160 $mg/cm^2/day$ or less measured in a 72-hour neutral salt spray test in accordance with JIS Z 2371.

12. The magnesium-lithium alloy according to claim 8, comprising not less than 2.57% by mass and not more than 15.00% by mass of Al.

* * * * *